United States Patent [19]

Chateau

[11] 4,030,469

[45] June 21, 1977

[54] ELECTRONIC IGNITION CIRCUIT

[75] Inventor: Louis Chateau, Rosny-sur-Bois, France

[73] Assignee: Ducellier & Cie, Paris Cedex, France

[22] Filed: Nov. 26, 1975

[21] Appl. No.: 635,359

[30] Foreign Application Priority Data

Dec. 12, 1974 France ..... 74.40897

[52] U.S. Cl. ..... 123/148 E; 315/209 T

[51] Int. Cl.[2] ..... F02P 1/00

[58] Field of Search ..... 123/148 E, 148 CB; 315/209 T, 209 CD

[56] References Cited

UNITED STATES PATENTS

| | | | |
|---|---|---|---|
| 3,871,347 | 3/1975 | Weber | 123/148 E |
| 3,885,534 | 5/1975 | Webster | 123/148 E |

*Primary Examiner*—Ronald B. Cox

[57] ABSTRACT

An electronic ignition circuit utilizing a magnetic pick-up winding has both ends of the pick-up winding connected by biasing resistor networks to the output terminal of the input stage of the circuit at which a positive going pulse appears when a negative going signal is induced in the pick-up winding. One end of the winding is connected by a diode to the base of a first transistor which controls a second transistor through a capacitor/resistor chain/diode series combination connected between the collector of the first transistor and said one end of the winding. The arrangement ensures that a spark can be produced even at low speed when a small signal is induced in the winding at the instant when ignition is required.

5 Claims, 1 Drawing Figure

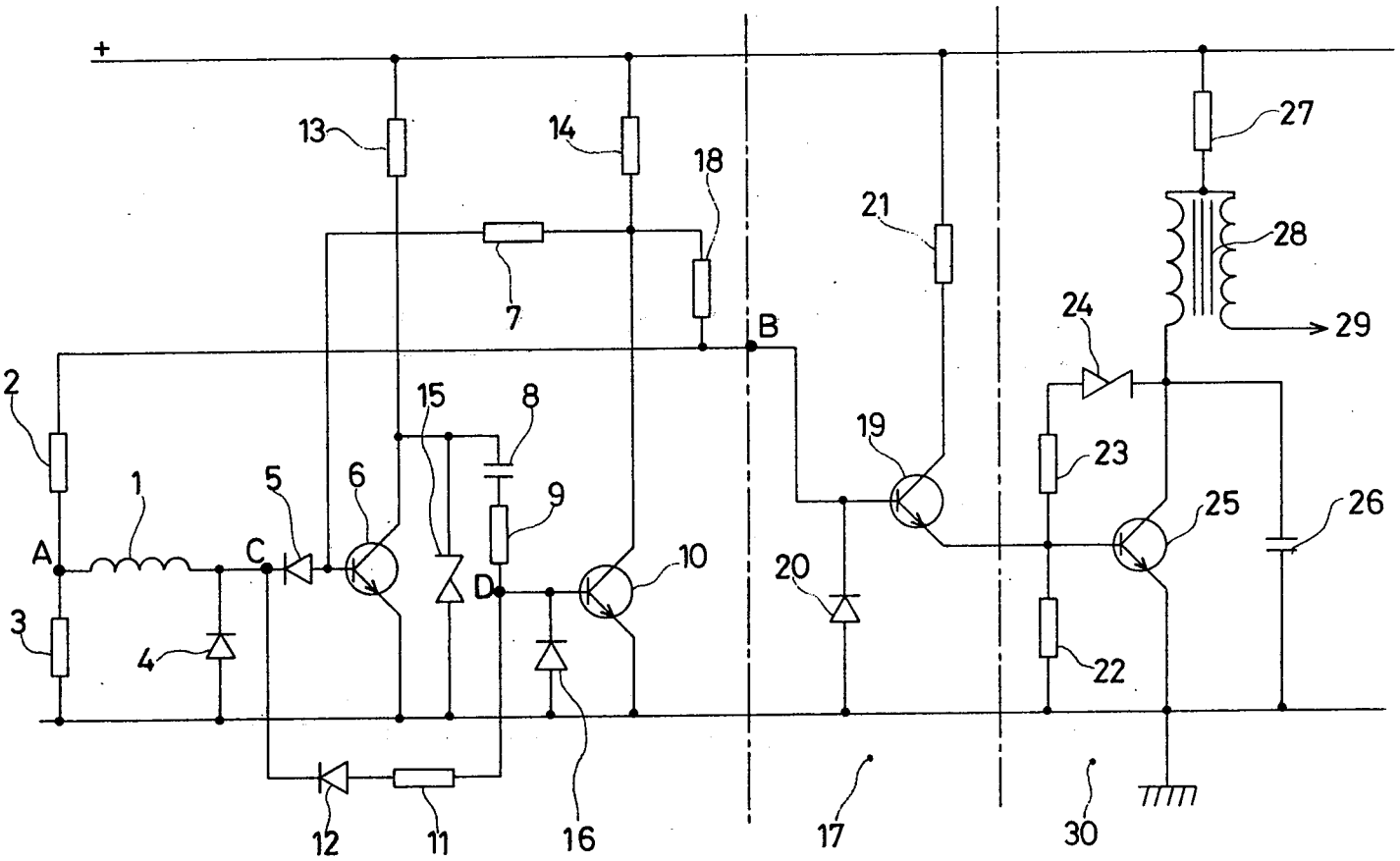
+
1
2
3
4
5
6
7
8
9
10
11
12
13
14
15
16
17
18
19
20
21
22
23
24
25
26
27
28
29
30
A
B
C
D

ELECTRONIC IGNITION CIRCUIT

The present invention relates to electronic ignition circuits particularly for motor vehicles equipped with an engine having controlled ignition.

In certain known devices a magnetic triggering winding which coacts with a rotating magnet is connected to earth at one of its ends and its second end is connected to the base of a transistor, through a diode of which the cathode is connected to the winding. The collector of the transistor controls the charging and discharging of a capacitor in series with a resistor connected on the one hand to earth and on the other hand to the following stage. This transistor includes in addition a biasing resistor connected to its base and to a following stage.

Now these arrangements give erratic results at slow speeds of rotation because on the one hand, the biasing resistor of the transistor being of small value, charges the magnetic sensor proportionately to this value and diminishes the amplitude of the sensed signal which is already weak at low speeds of rotation. The result is that the positive magnet triggering front causes the input stage to start oscillating and creates an uncontrolled and undesirable ignition advanced with respect to the desired ignition. On the other hand, the capacitive connection with feedback of the second stage via earth does not allow the very low frequencies to pass and thus does not react at low speeds.

The present invention has for an object to remedy these disadvantages and, to this end provides a circuit comprising the combination of a detector winding, a first transistor having its base connected via a first diode to one end of the detector winding, a second diode connecting said one end of the detector winding to an earth, a second transistor connected to control a power output stage for producing spark impulses, first and second resistors in series between a point in the power output stage and earth, the opposite end of the detector winding being connected to the junction of said first and second resistors, a capacitor, third and fourth resistors and a third diode connected in series between the collector of said transistor and said one end of the detector winding, the base of said second transistor being connected to the junction of the third and fourth resistors, and the first, second and third diodes being connected with their cathodes towards said one end of the detector winding whereby, in use, when the voltage at said one end of the detector winding is even weakly negative with respect to that at said opposite end thereof the first transistor is turned off so that said capacitor charges to turn on the second transistor and trigger the power output stage into producing a spark.

The single FIGURE of the attached drawing is a circuit diagram of an example of the invention.

The electronic ignition circuit shown includes an ignition coil 28 with a load resistance 27, which coil delivers the variations in voltage necessary for the reation of sparks at at least one spark plug 29. A power stage 30 consisting of a power transistor 25 with a load and protection elements drives the primary of the coil, the transistor 25 having associated with it two resistances 22 and 23, a Zener diode 24 and a condensor 26. An intermediate stage 17 composed of a transistor 19, a load resistance 21 and a diode 20 control the output transistor and an input stage in turn controls the intermediate stage. The input stage comprises a magnetic detector winding 1 (which is associated with a rotary magnet, not shown) two transistors 6 and 10, a condensor 8, protection circuits of the two transistors 6 and 10 composed of diodes 4, 5, 15, 16, resistors 13 and 14, a resistance 7 which is a biasing and feedback resistor for the base of the transistor 6, and a resistor 18 which, on the one hand assists the action of the resistor 7 and on the other hand ensures the connection between the intermediate stage and a point B which constitutes the output terminal of the input stage.

A resistance bridge, constituted by two resistors 2 and 3 in series, is connected between earth and the power stage at a point B of which the potential is substantially invariable with respect to earth when the transistors 19 and 25 are in conducting state. The free end of the winding 1 is connected to a point A at the junction between the two resistors 2 and 3. A condensor 8, of which one end is connected to the collector of the transistor 6, is in series with two resistors 9 and 11 and a diode 12 of which the cathode is connected to a point C, that is to say to the cathode of the diode 5. The base of the transistors 10 is connected to a point D between the two resistors 9 and 11.

The resistance bridge 2 and 3 biases the base of the transistor 6, thus the resistor 7 does not have to counteract the short circuit caused by the diode 5 and the winding 1 and can have a high ohmic value (relative to the values of resistors 2 and 3) which has the advantages of not alternating the signal from the detection winding at low speeds, and of rendering the transistor 6 always conducting in the absence of a signal in such a manner that only the negative half-cycle from the winding 1 acts to block the transistor 6, thus causing an ignition spark at the plug 29 without risk of an undesired ignition in advance of the desired ignition timing, by controlling in precise manner the charging and discharging of the condensor and consequently the state of conducting of the transistor 10.

Moreover, the resistor 11 which is connected to the diode 12 is of small value in order to avoid a large variation of the conduction time of the transistor unblocked by the condensor 8 at high speeds.

This diode 12 is blocked during the positive half cycle of the signal from the winding 1, thus the resistor 11 cannot shunt the emitter-base junction of the transistor 10 in the case of weak signals at the moment of starting. The ignition signal then transmitted by the condensor 8 then necessarily unblocks the transistor 10 which acts on the transistors 19 and 25.

As soon as the ignition signal is transmitted, the signal from the detector 1 passes a negative half cycle, the diode 12 having become conducting the resistance 11 then performs its function of calibrating the time of conduction of the transistor 10 at middle and high speeds.

Such a device thus has the advantage of creating an ignition timing at a low engine speed.

It is well understood that modifications can be made to such an embodiment without, however, departing from the scope of the invention.

I claim:

1. An electronic ignition circuit, particularly for the internal combustion engine of a motor vehicle, comprising the combination of a detector winding, a first transistor having its base connected via a first diode to one end of the detector winding, a second diode connecting said one end of the detector winding to an earth, a second transistor connected to control a power output stage for producing spark impulses, first and second resistors in series between a point in the power output stage and earth, the opposite end of the detector winding being connected to the junction of said first and second resistors, a capacitor, third and fourth resistors and a third diode connected in series between the collector of said transistor and said one end of the detector winding, the base of said second transistor being connected to the junction of the third and fourth resistors, and the first, second and third diodes being connected with their cathodes towards said one end of the detector winding whereby, in use, when the voltage at said one end of the detector winding is even weakly negative with respect to that at said opposite end thereof the first transistor is turned off so that said capacitor charges to turn on the second transistor and trigger the power output stage into producing a spark.

2. A circuit as claimed in claim 1 in which the point in the power output circuit to which said first resistor is connected is the base of a third transistor which is biased to conduct when the second transistor is non-conductive.

3. A circuit as claimed in claim 2 including a resistor in the collector circuit of the second transistor and first and second bias resistors connecting the collector of the second transistor to the bases of the first and third transistors respectively.

4. A circuit as claimed in claim 3 in which the first bias resistor is of high ohmic value as compared with said first and second resistors.

5. An input stage for an internal combustion engine electronic ignition system incorporating a magnetic position sensing device having a detector winding, said input stage comprising a supply rail, an earth rail, first and second input terminals between which said winding is to be connected, an output terminal, a first transistor, a first diode connecting the first input terminal to the base of the first transistor, a second diode connecting the first input terminal to said earth rail, the emitter of the first transistor being connected to the earth rail, a first collector resistor connecting the collector of the first transistor to the supply rail, first and second resistors connected in series between the output terminal and the ground rail, the junction of said first and second resistors being connected to the second input terminal, a capacitor one side of which is connected to the collector of the first transistor, third and fourth resistors connected in series with a third diode between the other side of said capacitor and the first input terminal, the cathodes of said first, second and third diodes being connected to the first terminal, a second transistor having its emitter connected to the earth rail and its base connected to the junction of the third and fourth resistors, a second collector resistor connecting the collector of the second transistor to the supply rail, and first and second biasing resistors connecting the collector of the second transistor to the base of the first resistor and the output terminal respectively.

* * * * *